US007035559B2

(12) United States Patent
Tanaka et al.

(10) Patent No.: US 7,035,559 B2
(45) Date of Patent: Apr. 25, 2006

(54) IMAGE FORMING DEVICE, COLOR CALIBRATION METHOD AND STORAGE MEDIUM STORING ITS PROGRAM

(75) Inventors: Satoshi Tanaka, Ebina (JP); Matsuyuki Aoki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/868,814

(22) Filed: Jun. 17, 2004

(65) Prior Publication Data

US 2005/0117926 A1 Jun. 2, 2005

(30) Foreign Application Priority Data

Dec. 2, 2003 (JP) ..... 2003-402638

(51) Int. Cl.
*G03G 15/00* (2006.01)
*G03G 15/01* (2006.01)

(52) U.S. Cl. ..... 399/49; 399/39

(58) Field of Classification Search ..... 399/39, 399/49, 58, 60, 72

See application file for complete search history.

(56) References Cited

U.S. PATENT DOCUMENTS

| | | | | |
|---|---|---|---|---|
| 3,150,305 | A | 9/1964 | Johnson et al. | |
| 6,172,771 | B1 * | 1/2001 | Ikeda et al. | 358/406 |
| 6,215,512 | B1 * | 4/2001 | Imaizumi et al. | 347/234 |
| 6,243,542 | B1 * | 6/2001 | Fujimoto et al. | 399/49 |
| 6,483,996 | B1 * | 11/2002 | Phillips | 399/38 |
| 2002/0118976 | A1 * | 8/2002 | Fischer | 399/49 |
| 2003/0219266 | A1 * | 11/2003 | Itagaki et al. | 399/38 |

FOREIGN PATENT DOCUMENTS

JP A-10-224653 8/1998

* cited by examiner

*Primary Examiner*—Sandra L. Brase
(74) *Attorney, Agent, or Firm*—Oliff & Berridge, PLC

(57) ABSTRACT

An image forming device comprises an image forming section that consecutively forms plural images on a plurality of recording media, a detecting section that detects, on the basis of an image formed in a storage medium, color development data indicating color development characteristics of the image, a warning control section that decides whether or not to issue warning information regarding the color development characteristics on the basis of the color development data detected by the detecting section and reference data which the color development characteristics are to reference, and a warning section that issues warning information regarding the color development characteristics in response to the decision by the warning control section.

14 Claims, 9 Drawing Sheets

FIG. 4A

| | |
|---|---|
| JOB 1 (FIRST SET) | PAPER A (THICK PAPER) |
| | IMAGE DATA #01 (ONE) |
| JOB 2 (FIRST SET) | PAPER B (COATED PAPER) |
| | IMAGE DATA #02 ~ #09 (ONE EACH) |
| JOB 3 (FIRST SET) | PAPER C (NORMAL PAPER) |
| | IMAGE DATA #10 ~ #50 (ONE EACH) |
| JOB 4 (FIRST SET) | PAPER A (THICK PAPER) |
| | IMAGE DATA #51 (ONE) |
| JOB 5 (SECOND SET) | PAPER A (THICK PAPER) |
| | IMAGE DATA #01 (ONE) |
| JOB 6 (SECOND SET) | PAPER B (COATED PAPER) |
| | IMAGE DATA #02 ~ #09 (ONE EACH) |
| JOB 7 (SECOND SET) | PAPER C (NORMAL PAPER) |
| | IMAGE DATA #10 ~ #50 (ONE EACH) |
| JOB 8 (SECOND SET) | PAPER A (THICK PAPER) |
| | IMAGE DATA #51 (ONE) |

FIG. 4B

| | |
|---|---|
| JOB 3.1 | SCREEN A |
| | IMAGE DATA #10~#20 (ONE EACH) |
| JOB 3.2 | SCREEN A<br>SCREEN B |
| | IMAGE DATA #21~#23 (ONE EACH) |
| JOB 3.3 | SCREEN A |
| | IMAGE DATA #24~#50 (ONE EACH) |

FIG. 5

| | |
|---|---|
| JOB 3.2 (FIRST SET) | SCREEN A<br>SCREEN B |
| | IMAGE DATA #21～#23 (ONE EACH) |
| JOB 3.3 (FIRST SET) | SCREEN A |
| | IMAGE DATA #24～#50 (ONE EACH) |
| JOB 4 (FIRST SET) | PAPER A (THICK PAPER) |
| | IMAGE DATA #51 (ONE) |
| CALIBRATION JOB | PAPER A, B, C<br>SCREEN A |
| | TEST IMAGE #0012 |
| JOB 5 (SECOND SET) | PAPER A (THICK PAPER) |
| | IMAGE DATA #01 (ONE) |
| JOB 6 (SECOND SET) | PAPER B (COATED PAPER) |
| | IMAGE DATA #02～#09 (ONE EACH) |

FIG. 6

| PAPER | SCREEN | TEST IMAGE | DIFFERENCE DATA | CALIBRATION VALUE |
|---|---|---|---|---|
| PAPER 1 | SCREEN 1 | NO. 0012 | AAA～BBB | +aaa |
| | | | BBB～CCC | +bbb |
| | | | ---- | ---- |
| PAPER 2 | SCREEN 1 | NO. 0014 | AAA～BBB | +fff |
| | | | BBB～CCC | +ggg |
| ---- | ---- | ---- | ---- | ---- |

S10

IMAGE FORMING DEVICE, COLOR CALIBRATION METHOD AND STORAGE MEDIUM STORING ITS PROGRAM

BACKGROUND OF THE INVENTION

1. Field of the Invention

The present invention relates to an image forming device that performs color calibration.

2. Description of the Related Art

It is known to provide an image processing method by which, where calibration is required while n images are being consecutively formed, the processing for image formation is suspended to process calibration and resumed after the completion of this calibration processing. Moreover, it is known to provide a method by which color patches are printed at regular intervals during the use of a printer, these color patches are detected with a sensor, and color calibration values are determined on the basis of the detected colors.

SUMMARY OF THE INVENTION

The present invention provides an image forming device capable of maintaining color development characteristics of consecutively formed images.

An image forming device according to the invention includes an image forming section that consecutively forms plural images on plural recording media, a detecting section that detects, on the basis of an image so formed in a recording medium, color development data indicating color development characteristics of the image, a warning control section that decides whether or not to issue warning information regarding the color development characteristics on the basis of the color development data detected by the detecting section and reference data which the color development characteristics are to reference, and a warning section that issues warning information regarding the color development characteristics in response to the decision by the warning control section.

BRIEF DESCRIPTION OF THE DRAWINGS

Preferred embodiments of the present invention will be described in detail with reference to the accompanying drawings, wherein:

FIGS. 4A and 4B show examples of job data generated by a job generating part 204, FIG. 4A showing print request data entered from a request acquiring part 200 and FIG. 4B showing a job further divided finely by the job generating part 204;

FIG. 5 shows an example of job data into which a calibration job is inserted;

FIG. 6 shows an example of calibration table referenced by a calibration value determining part 260 when determining a calibration value;

DESCRIPTION OF THE PREFERRED EMBODIMENTS

A first preferred embodiment of the present invention will be described below.

First will be described a printer device 10 to which the invention is applied.

Figure 1:
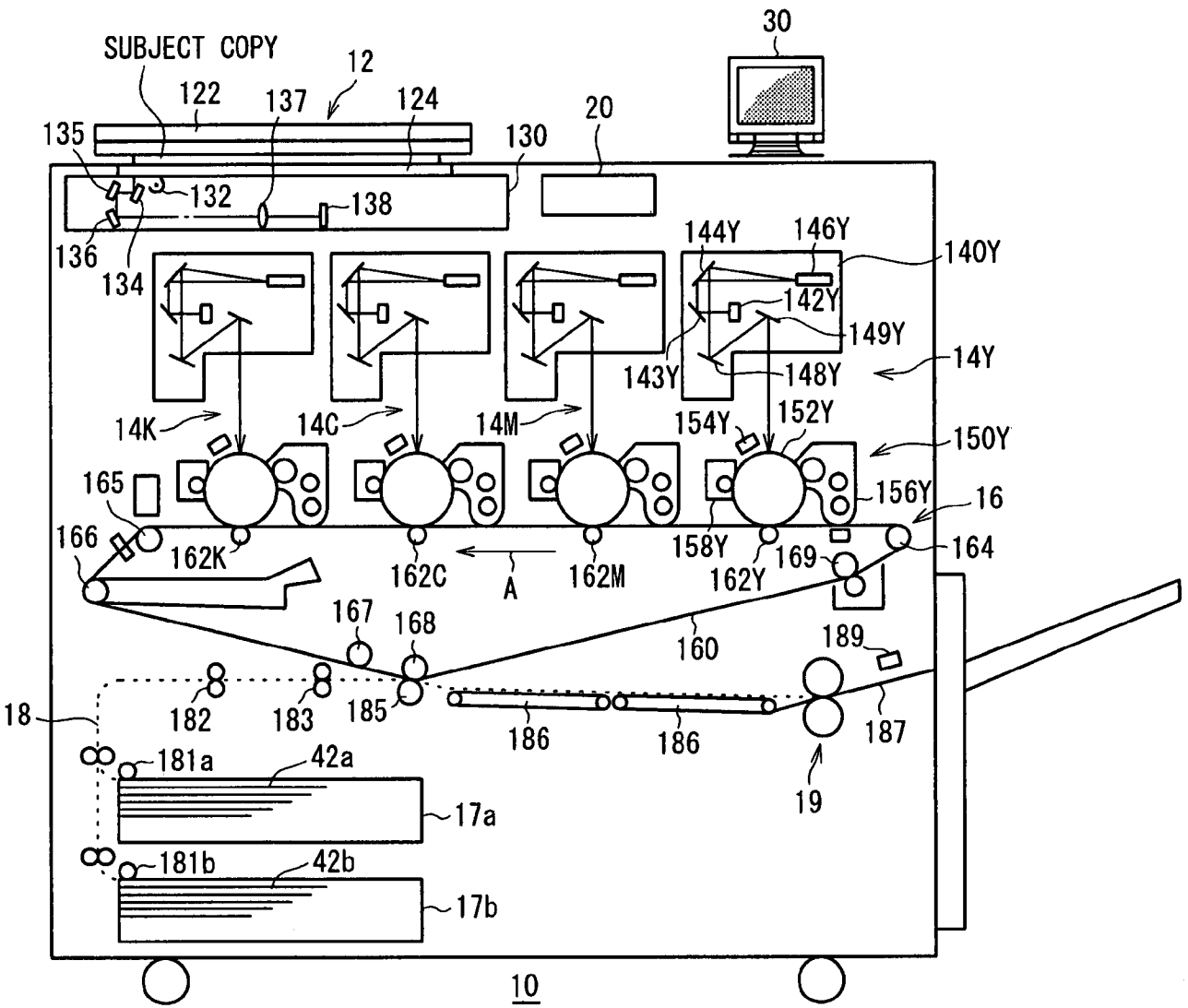
FIG. 1 illustrates the configuration of a tandem type printer device (image forming device) 10.

FIG. 1 illustrates the configuration of a tandem type printer device (image forming device) 10.

As shown in FIG. 1, the printer device 10 has an image reading unit 12, image forming units 14, an intermediate transfer device 16, plural paper sheet trays 17, a paper sheet carrying path 18, a fixer 19, image processing device 20 and a user interface device (UI device) 30. This printer device 10 may be a multifunction printer combining the function of a full color copying machine using the image reading unit 12 and that of a facsimile machine in addition to the printer function for printing image data received from a personal computer (not shown) and the like. While the tandem type printer device 10 provided with plural photosensitive drums 152 will be taken up as a specific example in the following description of this embodiment, the configuration is not limited to this, but a printer device provided with only one photosensitive drum 152, for instance, would be acceptable instead.

First to outline the printer device 10, over the printer device 10 are disposed the image reading unit 12, the image processing device 20 and the UI device 30. The image reading unit 12 reads an image represented on a subject copy and supplies the resultant image data to the image processing device 20. The image processing device 20 acquires image data entered from the image reading unit 12 or image data entered from a personal computer (not shown) and the like via a network line such as a LAN, subjects the acquired image data to image processing such as gradation correction and resolution correction, and supplies the corrected image data to the image forming units 14. Also, in response to entered image data and the user's instruction (i.e. his or her operation of the UI device 30), the image processing device 20 controls various constituent elements of the printer device 10 including the image forming units 14, the intermediate transfer device 16 and the image processing device 20. The UI device 30 is a user interface device, such as a touch panel, accepts the user's instruction and the like regarding print processing. Also, the UI device 30 displays information, such as the state of printing.

Underneath the image reading unit 12 are arranged plural image forming units 14 matching the colors constituting color images. In this example, a first image forming unit 14Y, a second image forming unit 14 M, a third image forming unit 14C and a fourth image forming unit 14K, respectively matching yellow (Y), magenta (M), cyan (C) and black (K), are disposed horizontally at regular intervals along the intermediate transfer device 16. The intermediate transfer device 16 turns an intermediate transfer belt 160 as the intermediate transfer medium in the direction of arrow A in FIG. 1. These four image forming units 14Y, 14M, 14C and 14K successively form toner images of the different colors on the basis of image data entered from the image processing device 20, and transfer these plural toner images to the intermediate transfer belt 160 (primary transfer) at the timing of the superposition of these toner images. The sequence of the colors of the image forming units 14Y, 14M, 14C and 14K are not limited to yellow (Y), magenta (M), cyan (C) and black (K), and they may be sequenced in any other way, such as black (K), yellow (Y), magenta (M) and cyan (C).

The paper sheet carrying path 18 is arranged underneath the intermediate transfer device 16. A recording paper sheet 42*a* or 42*b* fed from a first paper sheet tray 17*a* or a second paper sheet tray 17*b* is carried over this paper sheet carrying path 18, and undergoes a collective transfer (secondary transfer) of the toner images of different colors multiply transferred over the intermediate transfer belt 160. The transferred toner images are fixed by a fixer 37 and the sheet is discharged outside.

Next will be described in more detail the constituent elements of the printer device 10.

As shown in FIG. 1, the image reading unit 12 has a platen glass 124 on which to place a subject copy, a platen cover 122 for pressing this subject copy against the platen glass 124, and an image reading device 130 for reading the image of the subject copy placed on the platen glass 124. This image reading device 130 is so configured that the subject copy placed on the platen glass 124 is illuminated by a light source 132, an image reading element 138 made up of a CCD and the like is scan-exposed with the reflected light image from the subject copy via a reducing optical system made up of a full rate mirror 134, a first half rate mirror 135, a second half rate mirror 136 and an imaging lens 137, and this image reading element 138 reads the colorant reflected light image of the subject copy in a prescribed dot density (e.g. 16 dots/mm).

The image processing device 20 subjects the image data read by the image reading unit 12 to prescribed image processing including shading correction, positional correction of the subject copy, brightness/color space conversion, gamma correction, edge erase and editing to alter color or element position. Incidentally, the colorant reflected light image of the subject copy picked up by the image reading unit 12 are subject copy reflectance data in three colors, for instance red (R), green (G) and blue (B) (of 8 bits each), and are converted into subject copy colorant gradation data (luster data) of four colors including yellow (Y), magenta (M), cyan (C) and black (K) (of 8 bits each) by undergoing image processing by the image processing device 20.

The first image forming unit 14Y, the second image forming unit 14M, the third image forming unit 14C and the fourth image forming unit 14K are arranged side by side in the horizontal direction at regular intervals, and are configured substantially similarly to one another except that the colors of the images formed are different. Therefore, the following description will limit itself to the first image forming unit 14Y. The constituent elements of each image forming unit 14 will be distinguished from their respective counterparts in others by suffixing Y, M, C or K to their reference numerals.

The image forming unit 14Y has an optical scanning device 140Y for scanning laser beams according to image data entered from the image processing device 20 and an image forming device 150Y by which an electrostatic latent image is formed with laser beams scanned by this optical scanning device 140Y.

The optical scanning device 140Y modulates a semiconductor laser 142Y according to image data of yellow (Y), and emits a laser beam LB(Y) from this semiconductor laser 142Y according to the image data. This laser beam LB(Y) emitted from the semiconductor laser 142Y irradiates a rotating polygon 146Y via a first reflective mirror 143Y and a second reflective mirror 144Y, is deflectively scanned by this rotating polygon 146Y, and irradiates the photosensitive drum 152Y of the image forming device 150Y via the second reflective mirror 144Y, a third reflective mirror 148Y and a fourth reflective mirror 149Y.

The image forming device 150Y includes the photosensitive drum 152Y rotating in the direction of an arrow A at a prescribed speed and serving as an image carrier, a Scorotron 154Y for primary electrical charging, which serves as a charging section that uniformly charges the surface of this photosensitive drum 152Y, a developer 156Y for developing an electrostatic latent image formed over the photosensitive drum 152Y, and a cleaning device 158Y. The photosensitive drum 152Y is uniformly charged by Scorotron 154Y, and an electrostatic latent image is formed thereon by the laser beam LB(Y) radiated by the optical scanning device 140Y. The electrostatic latent image formed on the photosensitive drum 152Y is developed by the developer 156Y with a yellow (Y) toner, and transferred to the intermediate transfer device 16. Incidentally, after the step of transferring the toner image, the residual toner, paper powder and so forth sticking to the photosensitive drum 152Y are removed by the cleaning device 158Y.

The other image forming units 14M, 14C and 14K, in the same way as described above, also form toner images of different colors including magenta (M), cyan (C) and black (K), respectively, and transfer the toner images of different colors so formed to the intermediate transfer device 16.

The intermediate transfer device 16 has the intermediate transfer belt 160 wound with a constant tension round a drive roller 164, a first idle roller 165, a steering roller 166, a second idle roller 167, a backup roller 168 and a third idle roller 169, and rotational driving of the drive roller 164 by a drive motor (not shown) causes this intermediate transfer belt 160 to be circularly drive in the direction of the arrow A at a prescribed speed. The intermediate transfer belt 160 is formed by shaping, for instance, a film of flexible synthetic resin, such as polyimide, into a belt, which is made endless by connecting its two ends by welding.

Further, the intermediate transfer device 16 has a first primary transfer roller 162Y, a second primary transfer roller 162M, a third primary transfer roller 162C and a fourth primary transfer roller 162K in positions respectively opposite the image forming units 14Y, 14M, 14C and 14K, and multiply transfers to the intermediate transfer belt 160 via these primary transfer rollers 162 the toner images of different colors formed on the photosensitive drums 152Y, 152M, 152C and 152K. Incidentally, the residual toner sticking to the intermediate transfer belt 160 is removed with a cleaning blade or brush of a belt cleaning device disposed downstream from the secondary transfer position.

On the paper sheet carrying path 18 are arranged a first paper feed roller 181*a* and a second paper feed roller 181*b* for taking out a first recording paper sheet 42*a* or a second recording paper sheet 42*b* from a first paper sheet tray 17*a* or a second paper sheet tray 17*b*, paired rollers 182 for carrying paper sheets, and a resist roller 183 for carrying recording paper sheets 42*a* and 42*b* at a predetermined timing to the secondary transfer position.

Further in the secondary transfer position on the paper sheet carrying path 18 is disposed a secondary transfer roller 185 pressed against the backup roller 168, and the toner images of different colors multiply-transferred onto the intermediate transfer belt 160 undergo secondary transfers to a recording paper sheet 42*a* or 42*b* by the pressure and electrostatic force of this secondary transfer roller 185. The recording paper sheet 42*a* or 42*b* onto which toner images of different colors have been transferred are carried to the fixer 19 by two conveyor belts 186.

The fixer 19 melts and fixes the toners to the recording paper sheet 42*a* or 42*b*, to which the toner images of different colors have been transferred by subjecting them to heating and pressing.

The recording paper sheet 42*a* or 42*b* having undergone fixation (heating and pressing) by the fixer 19 is discharged outside the printer device 10 via a discharge path 187 (carrying path) disposed at a stage following the fixer 19, and stacked on a paper discharge tray. The discharge path 187 is further provided with a calorimetric sensor 189. The colorimetric sensor 189 may be, for instance, a colorimeter or a densitometer, which reads the image on the recording paper sheet 42*a* or 42*b*, and measures the characteristic quantities of this image. The characteristic quantities measurable by the calorimetric sensor 189 include, for instance, color development data (including the density, saturation, hue and distribution of each color) indicating color development characteristics.

Next will be described the background of the attempt at the present invention and this preferred embodiment thereof.

The printer device 10 may, for instance, accept from the user a request for printing of plural images. In such a case, the printer device 10 consecutively prints plural images in response to this printing request. When the printer device 10 consecutively prints plural images as in this case, variations in ambience or in hardware characteristics during the printing process may cause the density or gradation reproducibility of the printed images to change, resulting in differences in image quality among the plural images printed in compliance with the same printing request.

Therefore, it is preferable for the printer device 10, when consecutively printing images, to print a test image and perform color calibration processing on the basis of this test image. The color calibration processing in this context means adjustment of the printer device on the basis of the test image printed on a recording paper sheet, and this color calibration processing includes reading of the test image, difference detection to detect differences between reference hardware characteristics and the current hardware characteristics, and determination of the quantities of adjustment of hardware characteristics on the basis of this difference detection.

It is also conceivable to perform calibration processing during consecutive printing on the basis of toner images formed on the photosensitive drums 152 or the intermediate transfer belt 160. However, toner images formed on the photosensitive drums 152 are monochromic, and therefore it is difficult to estimate color development where toners of plural colors are superposed over one another. In addition, where toner images are melted and fixed on a recording paper sheet 42, color development is affected by the surface characteristics of the recording paper sheet 42, the sequence of the superposition of the toner images of plural colors, and the mutual influencing of the properties of these toners among other factors, making it difficult to predict the color development after fixation on the basis of the toner images formed on the intermediate transfer belt 160 or elsewhere and to perform color calibration according to the prediction. Therefore, it is preferable for the printer device 10 in this mode of implementing the invention to perform color calibration processing on the basis of toner images formed on a recording paper sheet 42. It is even more preferable for the image forming device 10 to perform color calibration processing on the basis of toner images fixed on a recording paper sheet 42.

Next will be described how the color development characteristics of the printer device 10 vary when the printer device 10 prints plural images while performing color calibration processing.

Figure 2A:
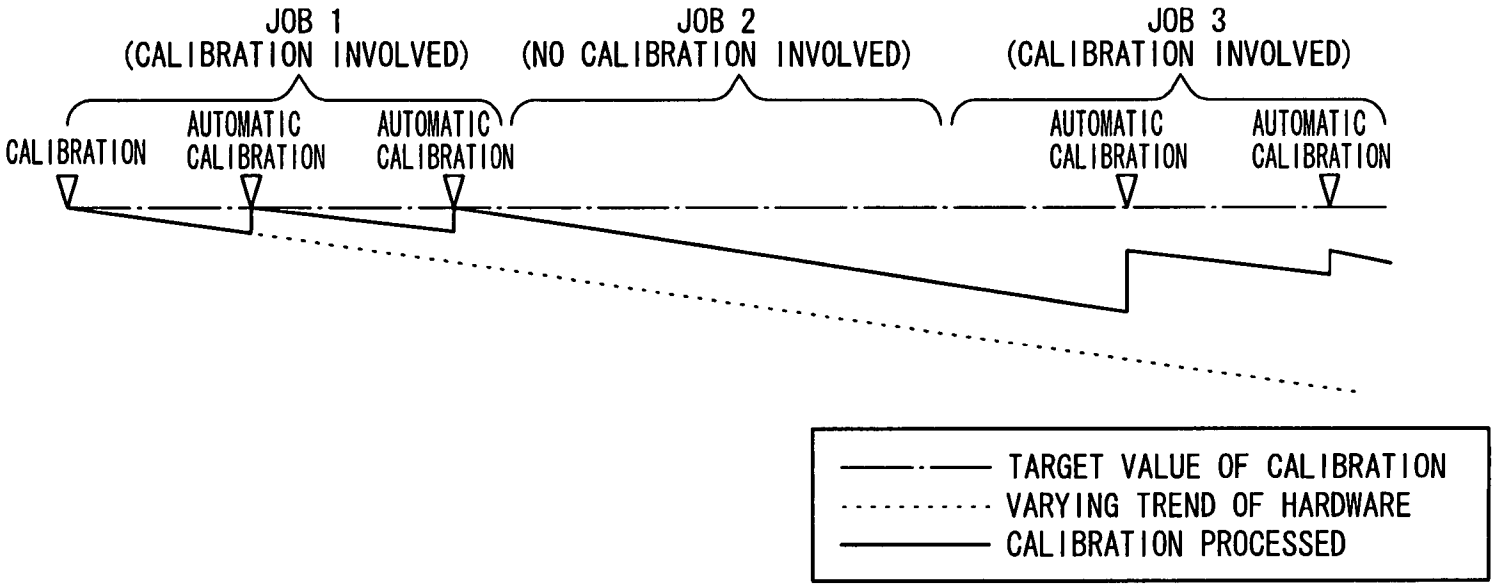
FIGS. 2A and 2B illustrate variations of color development characteristics in the printer device 10, FIG. 2A showing an example of variations of color development characteristics when only automatic color calibration processing is performed and FIG. 2B showing an example of variations of color development characteristics when manual color calibration processing is performed after a job 2.
Figure 2B:
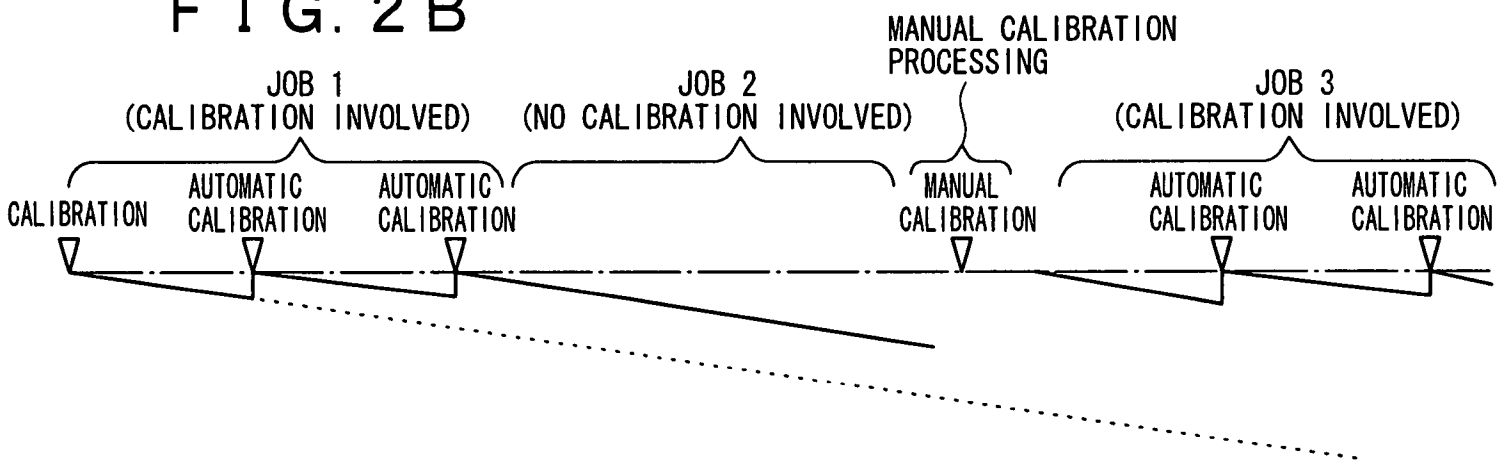

FIGS. 2A and 2B illustrate variations of color development characteristics in the printer device 10, FIG. 2A showing an example of variations of color development characteristics when only automatic color calibration processing is performed and FIG. 2B showing an example of variations of color development characteristics when manual color calibration processing is performed after a job 2. Herein, a job is a unit into which print processing requested by the user is divided. The automatic color calibration processing (first color calibration processing) means color calibration processing automatically performed at a predetermined timing while the printer device 10 is consecutively printing images, and manual color calibration processing (second color calibration processing) means color calibration processing that is performed by the user, who causes a desired test image to be printed, while checking this test image. Manual color calibration processing is performed during consecutive printing as, for instance, the print processing is interrupted at the instruction of the user.

Since automatic color calibration processing is thus performed when the printer device 10 is consecutively printing images, it is desirable for the number of test images that can be outputted and the time taken for computation in calibration processing to be limited for the purpose of maintaining the printing speed of the printer device 10 high enough. On the other hand, manual color calibration processing is performed by the user as he or she likes while the user causes as many test images to be printed as he or she becomes satisfied and checks the result of color calibration processing. Therefore, automatic color calibration processing is less accurate than manual color calibration processing and is more difficult to reflect the user's preference.

As illustrated in FIG. 2A the printer device 10 acquires print request data containing plural jobs from a user interface device, a personal computer or some other source, and processes these jobs. In that process, the color development characteristics of the printer device 10, as indicated by the broken line in this diagram, are caused to gradually deviate from their reference state (represented by the one-dot chain line) by changes in ambience or the aging of constituent parts. In order to correct its color development characteristics having varied over time (or with the increase of printed sheets), the printer device 10 automatically performs color calibration processing at a predetermined timing. However, the printer device 10 does not perform color calibration processing in every job. For instance, it performs no color calibration processing in a black-and-white printing job ("job 2" in this diagram), because color variations hardly occur in black-and-white printing which uses only the black (K) toner. On the other hand, in color printing in which plural toners are superposed one over another to develop specific colors, color development characteristics are susceptible to variations due to changes in the ratio among the toners of different colors.

If the printer device 10 automatically performs color calibration processing at a predetermined timing in such a state as illustrated in FIG. 2A, though the color development characteristics of the printer device 10 will be kept close to their target values (the user's preference) in "job 1", the color development characteristics of the printer device 10 will far deviate from their target values (the user's preference) in "job 2" in which no color calibration processing is performed. If the printer device 10 resumes automatic color calibration processing in "job 3" in such a state in which the color development characteristics have deviated far from their target values (the user's preference), correction to bring them closer to the target values may be impossible because the printable number of test images and the length of time available for color calibration processing are limited.

Moreover, if such a major correction is processed during consecutive printing, color development may significantly differ from one to another of the consecutively printed images, but the user may wish to avoid such differences in color development in a single series of prints.

In view of this point, the printer device 10 in this embodiment of the invention is enabled, when its color development characteristics have substantially deviated from their target values (reference data), to issue a warning to notify the user of the need for manual color calibration processing and urge him or her to perform manual color calibration processing.

When the user performs manual color calibration processing, the printer device 10 can return the color development characteristics to a state close to their target values (the user's preference) in "job 2" even after the color development characteristics have greatly varied as illustrated in FIG. 2B. Incidentally the user, even if notified of the need for manual color calibration processing, does not always have to perform manual color calibration processing, but can decide whether or not to perform manual color calibration processing by taking into account the state of the printed images, the number of sheets that remain to be printed and the length of time taken to perform manual color calibration processing.

Thus the printer device 10 in this embodiment of the invention prevents color calibration processing from being performed against the user's intention by detecting variations in its color development characteristics on the basis of the test images printed on recording paper sheets and issuing a warning when the color development characteristics have deviated far from their target values.

Figure 3:
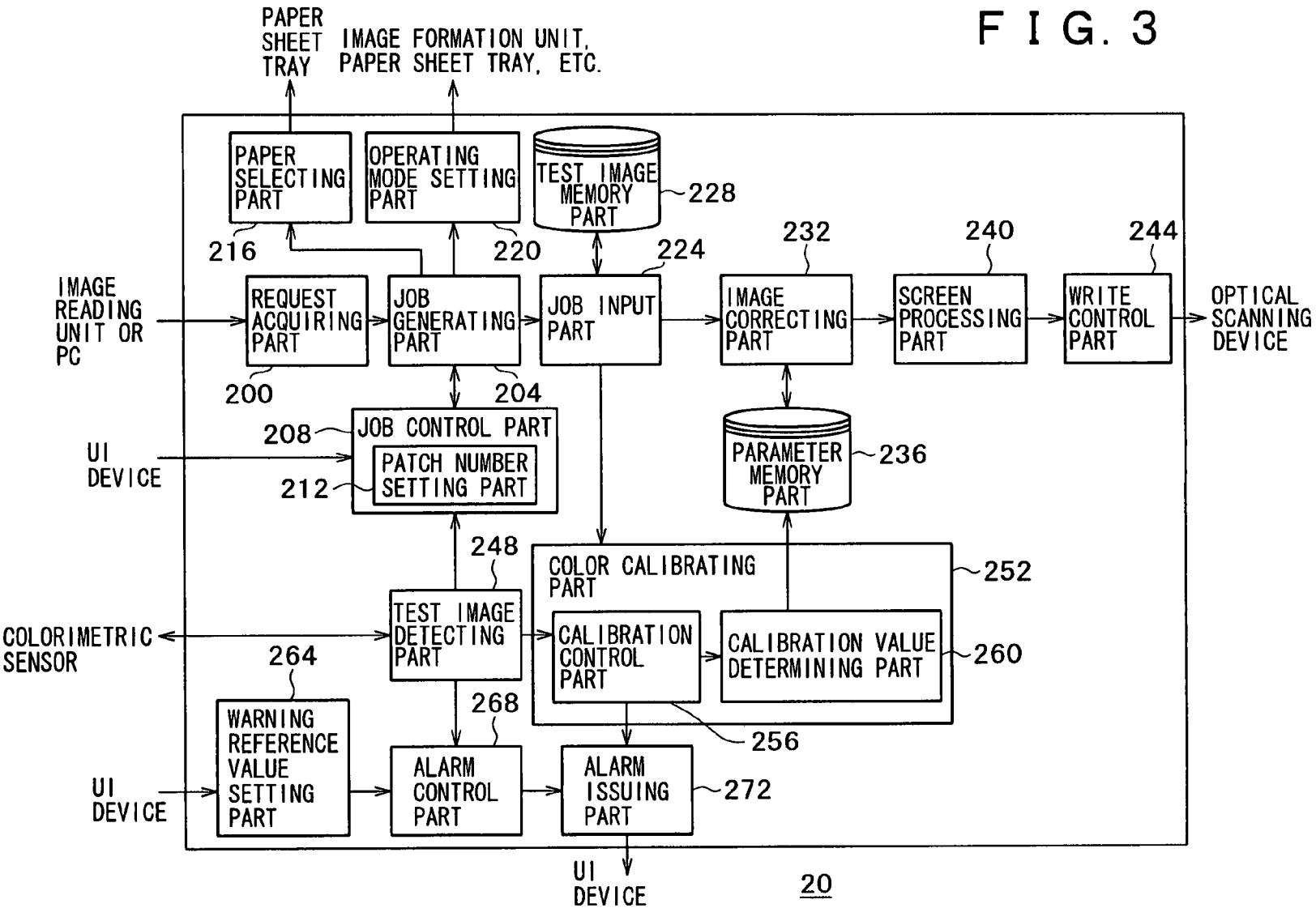
FIG. 3 shows an example of functional configuration of an image processing device 20.

FIG. 3 shows an example of functional configuration of the image processing device 20.

As illustrated in FIG. 3, the image processing device 20 includes a request acquiring part 200, a job generating part 204, a job control part 208, a paper selecting part 216, an operating mode setting part 220, a job input part 224, a test image memory part 228, an image correcting part 232, a parameter memory part 236, a screen processing part 240, a write control part 244, a test image detecting part 248, a color calibrating part 252, a warning reference value setting part 264, an alarm control part 268 and alarm issuing part 272. The job control part 208 further includes a patch number setting part 212, and the color calibrating part 252 includes a calibration control part 256 and a calibration value determining part 260.

To add, the constituent elements of the image processing device 20 described above may be implemented by either software or hardware.

In the image processing device 20, the request acquiring part 200 acquires print request data including image data and the like from either the image reading unit 12 (FIG. 1) or the user's personal computer, and supplies the acquired print request data to the job generating part 204. The print request data include the type of recording paper to be used for printing, the number of copies to be printed and designatory information designating post-processing, such as stapling, in addition to the image data whose printing has been requested by the user.

The job generating part 204 interprets print request data entered from the request acquiring part 200 to convert them into a job, which is a unit that can be processed at later steps, and supplies it to the job input part 224. The job generating part 204, when print request data that requests printing of plural images is entered for instance, divides the processing of the requested printing into plural processing units according to the continuity of the images to be printed and the continuity of the recording paper sheets to be printed on, and supplies the divided processing units, each as a job, to the job input part 224.

Also, the job generating part 204 supplies the paper selecting part 216 with paper discriminating information on the recording paper sheets to be used in each generated job, and supplies the operating mode setting part 220 with information to define the operating mode, including the type of the recording paper sheets to be used in the generated job, the size of the image to be printed and resolution.

The job control part 208 controls the sequence of jobs to be inputted to the job input part 224 and the timing of inputting. In this example, the job control part 208 so controls the job generating part 204 as to have jobs of color calibration processing (hereinafter referred to as automatic calibration jobs) make interrupts at predetermined timings. In doing so, the patch number setting part 212 sets, in accordance with predetermined conditions, the type and number of test images to be printed on the basis of each automatic calibration job, and the number of recording paper sheets on which the test images are to be printed, and causes the job generating part 204 to generate the automatic calibration jobs on the basis of these settings.

Also the job control part 208, when the user enters an instruction for color calibration processing via the UI device 30 (FIG. 1) so controls the job generating part 204 as to have jobs of manual calibration generated according to this instruction and to make interrupts for them. In doing so, the patch number setting part 212 sets in accordance with the request from the user the type and number of test images to be printed and the number of recording paper sheets on which the test images are to be printed, and causes the job generating part 204 to generate the manual calibration jobs on the basis of these settings. While the patch number setting part 212, when manual color calibration processing is to be performed, makes it possible to supply test images to be supplied according to the user's request in this way, only a predetermined number of test images are caused to be supplied in the case of automatic color calibration processing in order not to invite a significant fall in the productivity of the printer device 10.

Incidentally, the job control part 208 may as well instruct the calibration value determining part 260 to perform predictive calibration processing in parallel with the job under execution along with performing color calibration processing at the time of job switching by having the user-requested printed processing job be interrupted by a calibration job. The predictive calibration processing here means relative calibration processing which is performed by predicting the quantities of color fluctuations on the basis of predetermined parameters (including the variables generated by the color calibration processing immediately before) and the calibration values are determined on the basis of the result of this prediction, and differs from color calibration processing in that no test image is read.

The paper selecting part 216 selects one type of recording paper 42 out of plural types of recording paper (the recording paper 42*a* and the recording paper 42*b* in this embodiment) by controlling the paper sheet trays 17, paper feed rollers 181 and other elements, and feeds sheets of the selected recording paper 42 to the paper sheet carrying path 18. For instance the paper selecting part 216, when an image according to the user's request is to be printed, selects the type of recording paper 42 conforming to the user's instruction or, when test images for color calibration are to be printed, selects the type of recording paper 42 to undergo color calibration (i.e. the type of recording paper to be used in the ensuing jobs).

The operating mode setting part 220 determines the operating mode on the basis of mode defining information entered from the job generating part 204, and causes the image forming unit 14 (FIG. 1), the intermediate transfer device 16 and other elements in the determined operating mode. In this example, the operating mode setting part 220 sets the operating mode in which the process speed of image formation is to be controlled on the basis of the mode defining information. For instance, the operating mode setting part 220 controls the intervals between the toner images to be transferred onto the intermediate transfer belt 160 and the timing of carriage of the recording paper sheets 42 by the resist roller 183 according to the size of the images to be outputted (for instance, the size of the recording paper sheets 42). Also, the operating mode setting part 220 controls the speed of writing by the optical scanning devices 140 and the turning speeds of the photosensitive drums 152 and of the intermediate transfer belt 160 according to the resolution of the images to be supplied.

The job input part 224 acquires a job from the job generating part 204, and performs processing according to the content of the acquired job. If, for instance, the acquired job is part of print processing requested by the user, the job input part 224 supplies the image correcting part 232 with image data to be printed in this job. Or if the acquired job is an automatic calibration job or a manual calibration job, the job input part 224 reads test images (images for color calibration use) out of the test image memory part 228, and supplies the image correcting part 232 with the data of the test images that have been read out. In doing so, the job input part 224 supplies the color calibrating part 252 with identifying information for the test images read out of the test image memory part 228.

The test image memory part 228 stores in advance data of the test images for use in color calibration processing. Although in this embodiment the printer device 10 prints test images prepared in advance for color calibration use, the usable test images are not limited to them, but part or all of the image data whose printing has been requested by the user (i.e. image data included in the print request data) may as well be printed as test images for instance, and used for color calibration.

The image correcting part 232 processes image data entered from the job input part 224 for gradation correction and sharpness correction, and supplies the corrected data to the screen processing part 240. In doing so, the image correcting part 232 references a look-up table stored in the parameter memory part 236 and determines the quantities of the gradation correction and the sharpness correction. The parameter memory part 236 stores coefficients of correction for use in various corrections including gradation correction and sharpness correction, and the image correcting part 232 performs corrections, on the basis of coefficients of correction stored in the parameter memory part 236, so that the entered image data be reproduced on the recording paper 42 in the desired color and sharpness.

The screen processing part 240 subjects (multi-value) image data entered from the image correcting part 232 to screen processing to convert them into two-value image data, and supplies the converted data to the write control part 244. The screen processing part 240 switches over the screen according to the attribute (photographic image, character image, line drawing or whatever else) of the image. If, for instance, a photographic image area and a character image area are mixed in one page of image, the screen processing part 240 switches over the screen for each of these image areas.

The write control part 244 controls the optical scanning devices 140 (FIG. 1) according to the (two-value) image data entered from the screen processing part 240. For instance, the write control part 244 intermittently turns on the optical scanning devices 140 by generating a pulse signal according to the entered image data and supplying this pulse signal to the optical scanning devices 140.

The test image detecting part 248 controls the colorimetric sensor 189 (FIG. 1) to read a test image printed on a recording paper sheet 42, and measures characteristic quantities of the test image. The test image detecting part 248 supplies the measured characteristic quantities to the color calibrating part 252.

The color calibrating part 252 includes the calibration control part 256 and the calibration value determining part 260. The calibration control part 256 determines, on the basis of the characteristic quantities of the test image detected by the test image detecting part 248, whether or not to have the result of color calibration processing in image formation processing. In more specific terms, the calibration control part 256 computes according to the automatic calibration job the difference value between each characteristic quantity of the test image entered from the test image detecting part 248 and the pertinent predetermined target value (numerical value matched with identifying information for the test image); if the computed difference value is not greater a prescribed threshold, causes the calibration value determining part 260 to update the coefficient of correction in the parameter memory part 236 or, if the computed difference value is greater than this threshold, forbids updating of the coefficient of correction in the parameter memory part 236; and instructs the alarm issuing part 272 to issue warning information. Incidentally, where the calibration control part 256 is to perform color calibration processing according to a manual calibration job, it causes the coefficient of correction in the parameter memory part 236 to be updated without relying on the difference values between the characteristic quantities of the test image and the target values.

The calibration value determining part 260 performs either color calibration processing based on the characteristic quantities of the test image detected by the test image detecting part 248 (hereinafter referred to as measured calibration processing) or color calibration processing based on predetermined color calibration values (hereinafter referred to as predictive calibration processing). More specifically, the calibration value determining part 260 determines color calibration values by comparing the characteristic quantities entered from the test image detecting part 248 as measured calibration processing and the target values of color calibration processing (for instance, preset fixed values matched with identifying information for the test image), and updates the look-up table (of coefficients of correction) stored in the parameter memory part 236 according to these color calibration values. Thus, the calibration value determining part 260 determines calibration values for the device on the basis of the characteristic quantities entered from the test image detecting part 248, and adjusts the colors of images supplied from the printer device 10 according to these calibration values. Incidentally the calibration value determining part 260, when determining calibration values on the basis of an automatic calibration job, applies an algorithm which takes less time to process than when determining calibration values on the basis of a manual calibration job, and thereby restrains the productivity drop due to automatic calibration processing. Further, the calibration value determining part 260 stores calibration values determined on the basis of a manual calibration job and calibration values determined on the basis of an automatic calibration job differentiated from each other, and updates the coefficients of correction stored in the parameter memory part 236.

In particular, it is preferable for the test image detecting part 248 to measure characteristic quantities with respect to colors developed by plural toners and for the calibration value determining part 260 to determine color calibration values on the basis of the characteristic quantities derived from these plural toners.

Further, the calibration value determining part 260 computes, as predictive calibration processing, predicted color calibration values on the basis of predetermined color calibration values, and updates the look-up table stored in the parameter memory part 236 according to these predicted values. The predictive calibration processing here includes prediction of color calibration values which would become required with reference to the state at a preceding check point (for instance, the starting time of the job or the time of previous color calibration processing) as targets and prediction of the quantities of color variation (or color calibration values) on the basis of the quantities of color variation (or color calibration values) regarding other recording paper sheets and screens.

Although in this embodiment of the invention the color calibrating part 252 adjusts the color development characteristics of the printer device 10 by updating the look-up table stored in the parameter memory part 236, the way of color calibration is not limited to this. For instance, color calibration of the printer device 10 can as well be implemented by adjusting the secondary transfer processing (in terms of squeezing force or electrostatic force) by the secondary transfer roller 185 or by adjusting the fixation processing (in terms of heating temperature or pressure applied) by the fixer 19 and thereby regulating the color development of images formed on the recording paper 42.

The warning reference value setting part 264 accepts the inputting of a warning reference value, which is to be referenced in issuing a warning, from the user via the UI device 30 (FIG. 1), and supplies the entered warning reference value to the alarm control part 268. The warning reference value in this example is a data item indicating the range of difference values between the characteristic quantities of the test image and the pertinent target values permissible by the user.

The alarm control part 268 determines, on the basis of the characteristic quantities of the test image (color development data) entered from the test image detecting part 248, whether or not to issue warning information to the user and, if it is determined that warning information should be issued, instructs the alarm issuing part 272 to issue warning information. More specifically, the alarm control part 268 computes a difference value between each characteristic quantity entered from the test image detecting part 248 and a pertinent predetermined target value (reference data), and compares the computed difference value with the warning reference value entered from the warning reference value setting part 264. The alarm control part 268, if the computed difference value is greater than the warning reference value, instructs the alarm issuing part 272 to issue warning information to the effect that manual color calibration processing is required or, if not, forbids the alarm issuing part 272 from supplying warning information. The reference data here (the target values in this example) means the criteria for evaluating color development characteristics including, for instance, the target values or target data ranges for color development characteristics. Therefore, whereas the alarm control part 268, as in this example, decides whether or not to issue warning information according to whether or not the difference value between color development data and reference data is within a predetermined permissible range, the decision on whether or not to issue warning information may as well be based on whether or not the color development data are within the range of the reference data.

The alarm issuing part 272 generates warning information in response to control by the calibration control part 256 or the alarm control part 268, and supplies it to the UI device 30 (FIG. 1) and the like. More specifically the alarm issuing part 272, if an instruction to issue a warning is received from the calibration control part 256, supplies warning information to the effect that the result of color calibration processing is not to be reflected or, if an instruction to issue a warning is received from the alarm control part 268, supplies warning information to the effect that manual color calibration processing is needed. Incidentally, the alarm issuing part 272 may either transmit warning information to the user's personal computer (not shown) or issue warning information by lighting an alarm lamp or emitting an alarm sound.

FIGS. 4A and 4B show examples of job data generated by the job generating part 204, FIG. 4A showing print request data entered from the request acquiring part 200 and FIG. 4B showing a job further divided finely by the job generating part 204.

As illustrated in FIG. 4A, the request acquiring part 200 acquires print request data involving plural jobs from the user's personal computer or some other source. The print request data in this example involve plural kinds of jobs differing from one another in the type of recording paper to be printed on (normal paper, thick paper, coated paper, or whatever else). Also, this print request data contains plural sets, each made up of the same content to be printed, such as "job 1" through "job 4" and "job 5" through "job 8". Each job, resulting from division of a sequence of print processing by the type of recording paper to be used for this print processing, contains information designating the image data to be printed and the type of recording paper to be used.

Further, as illustrated in FIG. 4B, the job generating part 204 further divides "job 3" entered from the request acquiring part 200 into "job 3.1", "job 3.2" and "job 3.3". The job generating part 204 performs this subdivision to reduce the number of sheets to be printed in each of the individual jobs ("job 3.1" through "job 3.3") to a level not surpassing a preset upper limit because the number of sheets to be printed in "job 3" exceeds the limit.

Also, the job generating part 204 divides jobs according to the combination of screens used by the screen processing part 240. Incidentally, although the screen processing part 240 in this embodiment selects a screen according to the image attribute in each image area, the screen applied by the screen processing part 240 may as well be selected by the image processing device 20 as designated by the user. Further, the printer device 10 may as well acquire from the user image data that has already undergone screen processing.

FIG. 5 shows an example of job data into which a calibration job is inserted.

As illustrated in FIG. 5, the job generating part 204 inserts, in response to control by the job control part 208, an automatic calibration job or a manual calibration job between plural jobs generated on the basis of print request data. The automatic calibration job is a job of printing a test image by use of the type of recording paper and screen for use in ensuing jobs, while the manual calibration job is a job of printing a test image by use of the type of recording paper and screen designated by the user.

The calibration job in this embodiment is inserted at the time of changing over from one set to another (between "job 4" and "job 5"). This enables a recording paper sheet on which a test image is printed from getting blended into a set and the user to know the border between sets. Furthermore, since no major color adjustment is done while one set is being printed, no conspicuous color fluctuations will occur in the same set.

FIG. 6 shows an example of calibration table referenced by the calibration value determining part 260 when determining a calibration value.

As illustrated in FIG. 6, the calibration value determining part 260 has a calibration table for matching the type of the recording paper 42, that of the screen, identifying information for test images and difference data to calibration values. The difference data is data representing differences between characteristic quantities read from the test image printed on a recording paper sheet and the reference characteristic quantities set as target values of color calibration.

Figure 7:
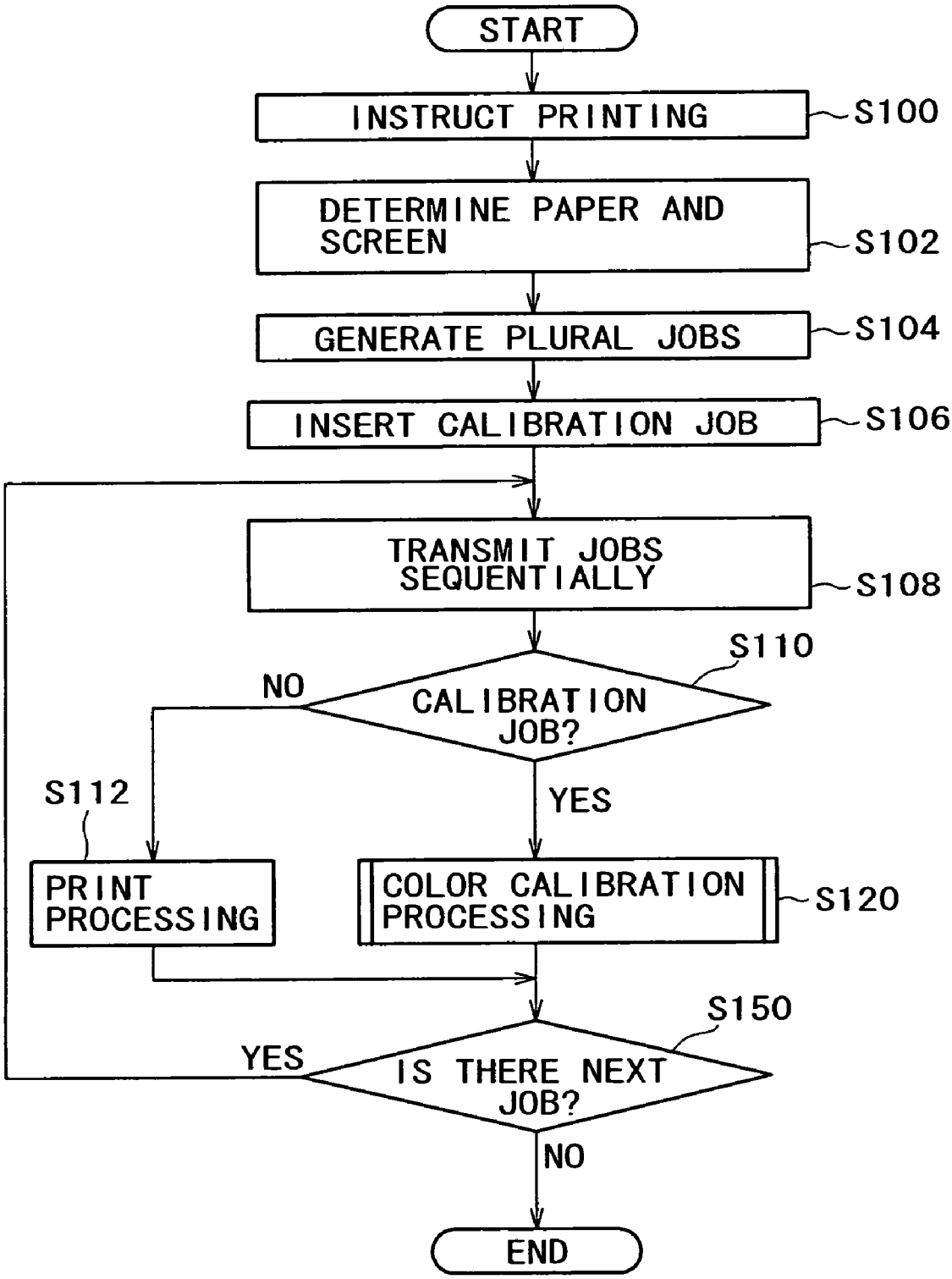
FIG. 7 is a flowchart of print processing (S10) by the printer device 10.

FIG. 7 is a flowchart of print processing (S10) by the printer device 10.

As charted in FIG. 7, at step 100 (S100), the user makes a printing request via his or her personal computer or the UI device 30 (FIG. 1). The request acquiring part 200, when print request data containing at least one job are entered, the user acquires via a network or the image reading unit 12 the image data to be printed in compliance with the printing request, and supplies it to the job generating part 204.

At step 102 (S102), the job generating part 204 analyzes each job contained in the print request data acquired from the request acquiring part 200, and determines the type of recording paper and the screen to be used. Also, the job generating part 204 supplies identifying information for the determined type of recording paper to the paper selecting part 216, and the paper selecting part 216 in response so controls the paper sheet trays 17 (FIG. 1) and the paper feed roller 181 (FIG. 1) as to cause recording paper sheets to be fed to the secondary transfer position.

At step 104 (S104), the job generating part 204 analyzes the number of sheets to be printed in each job and, if the number of sheets to be printed in any job exceeds the upper limit, further divides the job according to the type of the recording paper or the screen, and keeps the number of sheets to be printed in the job at or below the upper limit.

At step 106 (S106), the job control part 208 instructs the job generating part 204 to have an automatic calibration job interrupt at the timing of changing over the set, the type of the recording paper or the screen (i.e. the timing at which the continuity of the images to be printed or of the recording paper used for printing is disrupted).

The patch number setting part 212 adds to an automatically configured job identifying information for test images (test images meeting limitation for maintaining productivity (as to the size and number of test images and the number of recording paper sheets)) matching automatic calibration processing.

The job generating part 204, in response to an instruction from the job control part 208, searches plural jobs for the timing at which the set, the type recording paper or the screen is switched over, inserts an automatic calibration job between the jobs found by the search, and supplies it to a job output part 250.

At step 108 (S108), the job generating part 204 successively supplies the job input part 224 with at least one job that has been generated.

At step 110 (S110), the job input part 224 analyzes the jobs entered from the job generating part 204.

The job input part 224, if the entered job is an automatic calibration job or a manual calibration job, shifts to the processing of S120 or, if it is not, shifts to the processing of S112.

At step 112 (S112), the job input part 224 supplies image data contained in the job data to the image correcting part 232. The image correcting part 232 references the look-up table stored in the parameter memory part 236, processes picture quality correction including gradation correction on the image data entered from the job input part 224, and supplies the corrected data to the screen processing part 240. The screen processing part 240, using a screen determined by the job generating part 204, converts the (multi-value) image data entered from the image correcting part 232 into two-value image data, and supplies the converted data to the write control part 244. The write control part 244 causes, according to the image data entered from the screen processing part 240, a latent image to be written onto the surfaces of the photosensitive drums 152 by intermittently turning on the optical scanning devices 140. The latent image written onto the photosensitive drums 152 is developed with toners of different colors, multiply transferred-by the intermediate transfer device 16 to the recording paper 42, and undergoes fixation by the fixer 19. The recording paper 42 having undergone the fixation is discharged out of the printer device 10 via the discharge path 187.

At step 120 (S120), the printer device 10 prints the test image on the recording paper 42, reads the test image printed on the recording paper 42, and detects the characteristic quantities of the test image. Then, the printer device 10 notifies the user of warning information including the need for manual color calibration processing or whether or not to have the result of automatic color calibration processing reflected according to the detected characteristic quantities. Also the printer device 10, according to the user's operation in response to this warning information, performs automatic color calibration processing or manual color calibration processing to adjust the color development characteristics.

At step 150 (S150), the job input part 224 determines whether or nor there is any ensuing job and, if there is any, returns to the processing of S108 to process the next job or, if not, ends the print processing (S10).

Figure 8:
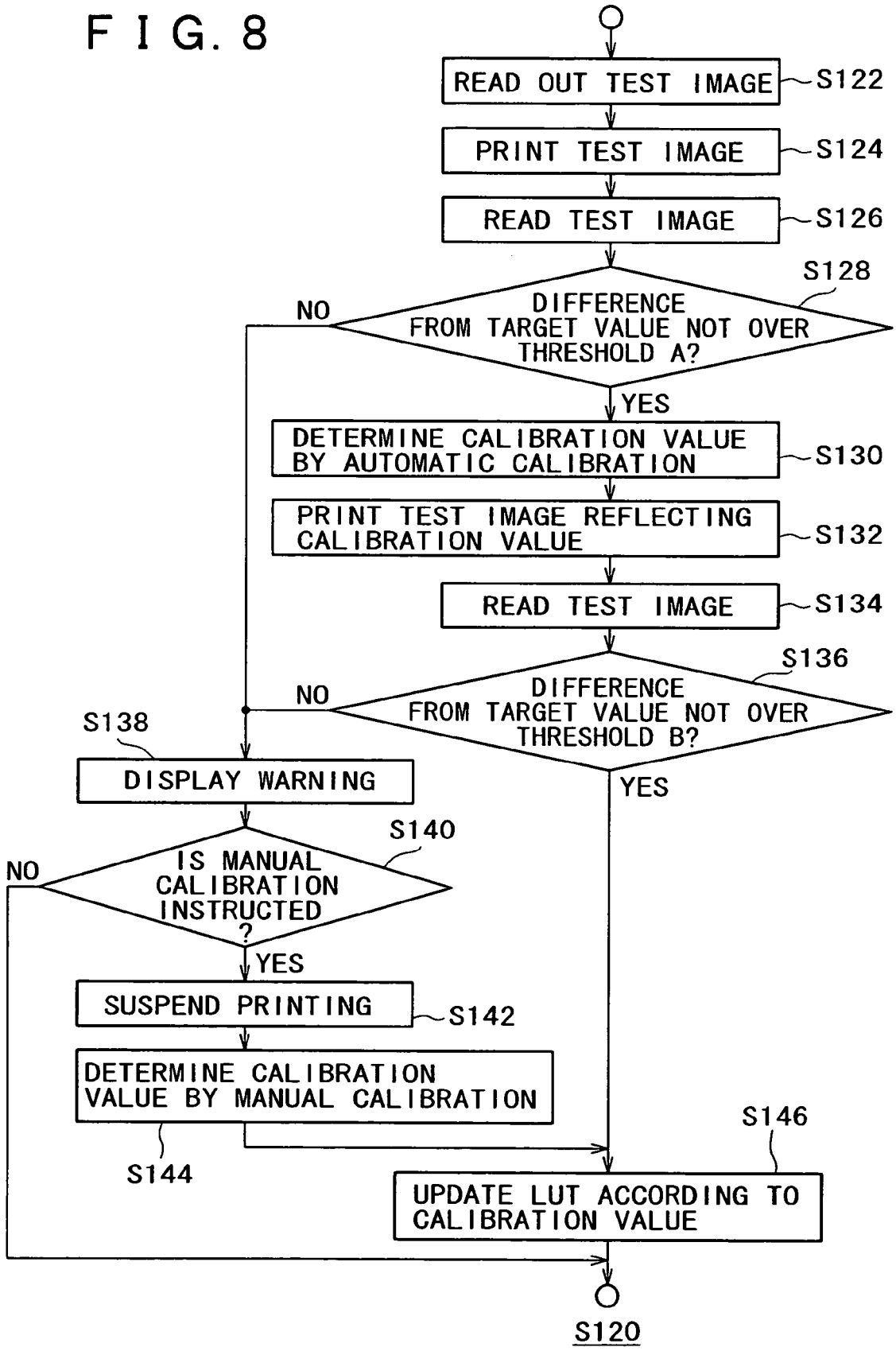
FIG. 8 is a flowchart of color calibration processing (S120) by the printer device 10.

FIG. 8 is a flowchart of color calibration processing (S120) by the printer device 10.

As charted in FIG. 8 at step 122 (S122), the job input part 224 reads out data of the test image out of the test image memory part 228 according to the entered automatic calibration job, supplies data of the read-out test image to the image correcting part 232. Also, the job input part 224 supplies the color calibrating part 252 with identifying information for the test image that has been supplied to the image correcting part 232.

At step 124 (S124), the image correcting part 232 references the look-up table stored in the parameter memory part 236, processes picture quality correction including gradation correction on the data of the test image entered from the job input part 224, and supplies the corrected data to the screen processing part 240. The screen processing part 240, using a screen designated by the automatic calibration job (i.e. a screen to be used by an ensuing job), converts the (multi-value) data of the test image entered from the image correcting part 232 into two-value image data, and supplies the converted data to the write control part 244. The write control part 244 causes, according to the data of the test image entered from the screen processing part 240, a latent test image to be written onto the surfaces of the photosensitive drums 152 by intermittently turning on the optical scanning devices 140. The latent test image written onto the photosensitive drums 152 is developed with toners of different colors, multiply-transferred by the intermediate transfer device 16 to the recording paper 42 designated by the automatic calibration job (i.e. the recording paper 42 to be used by an ensuing job), and undergoes fixation by the fixer 19. The recording paper 42 having undergone the fixation is discharged out of the printer device 10 via the discharge path 187.

At step 126 (S126), the calorimetric sensor 189 disposed on the discharge path 187, in response to control by the test image detecting part 248, optically reads the test image printed on the recording paper 42, and supplies it to the test image detecting part 248. The test image detecting part 248 extracts, on the basis of the test image entered from the colorimetric sensor 189, the characteristic quantities of the test image (color development data), and supplies the extracted characteristic quantities to the alarm control part 268 and the color calibrating part 252.

At step 128 (S128), the alarm control part 268 computes the difference value between the characteristic quantities entered from the test image detecting part 248 and the pertinent predetermined target value, and compares the computed difference value with a warning reference value preset by the warning reference value setting part 264 (threshold A). The printer device 10, if the computed difference value (absolute value) is not greater than the warning reference value (threshold A), will shift to processing at S130 or, if the computed difference value is greater than the warning reference value, shift to processing at S138.

At step 130 (S130), the calibration value determining part 260 computes the difference value between the characteristic quantities of the test image entered from the test image detecting part 248 and a predetermined target value matching the identifying information for the test image, and determines a calibration value corresponding to this difference value.

At step 132 (S132), the calibration value determining part 260, in order to print the test image, updates the look-up table on the basis of the determined calibration value, and the job input part 224, the image correcting part 232, the screen processing part 240 and the write control part 244, references the updated look-up table according to this automatic calibration job, and prints the test image again on the recording paper 42. Thus, the printer device 10 does not have the result of this color calibration processing reflected in the print processing requested by the user, but causes the result of the automatic color calibration processing only in the printing of the test image.

At step 134 (S134), the test image detecting part 248 reads from the recording paper 42 the test image printed in a state in which the result of color calibration processing is reflected, extracts this characteristic quantity of the test image, and supplies the extracted characteristic quantity (which reflects the result of calibration) to the calibration control part 256.

At step 136 (S136), the calibration control part 256 computes the difference value between the characteristic quantity (which reflects the result of calibration) entered from the test image detecting part 248 and a predetermined target value matching the identifying information for the test image, and compares the computed difference value and the predetermined reference value (threshold B). The printer device 10, if the computed difference value (which reflects the result of calibration) is not greater than the reference value (threshold B), will shift to processing at S146 or, if the computed difference value is greater than the reference value (threshold B), shift to processing at S138. Thus, the printer device 10, if the characteristic quantity of the test image printed in a state in which the result of color calibration processing is reflected (color development data) is within the range of target data, will cause the result of automatic color calibration processing to be reflected in the print processing requested by the user or, if this characteristic quantity is outside the range of target data, will not cause the result of automatic color calibration processing to be reflected and urge manual color calibration processing.

At step 138 (S138) the alarm issuing part 272, in accordance with an instruction from the alarm control part 268 or the calibration control part 256, generates warning information to give a notice to the effect that manual color calibration processing is needed or the result of automatic color calibration processing is not reflected, and causes the generated warning information to be displayed on the UI device 30 (FIG. 1) and the like.

At step 140 (S140), the UI device 30 accepts the user's instructions for manual color calibration processing only for a predetermined period. The printer device 10, if an instruction for manual color calibration processing is accepted within the predetermined period, will shift to processing of S142 or, if not, end the color calibration processing (S120). Thus, the printer device 10, if no instruction for manual color calibration processing is made within the predetermined period, will continue the rest of print processing without performing color calibration processing. This enables the user to prevent any major color fluctuation from occurring in a set of printed matters.

At step 142 (S142) the job control part 208, in accordance with an instruction accepted via the UI device 30, causes the job generating part 204 to generate a manual calibration job and to have it interrupt at the beginning of unprocessed jobs. The interruption by the manual calibration job causes the printer device 10 to suspend print processing and to let manual color calibration processing start.

At step 144 (S144), the patch number setting part 212 determines the number of test images to be printed and other factors in response to the user's operation, and causes the job generating part 204 to generate a manual calibration job corresponding to the determined number of test images. The job input part 224, the image correcting part 232, the screen processing part 240 and the write control part 244 print as many test images as the user desires in accordance with the generated manual calibration job. The calibration value determining part 260 determines the calibration value on the basis of the characteristic quantities of the printed test images.

At step 146 (S146), the calibration value determining part 260 updates the look-up table stored in the parameter memory part 236 according to a calibration value based on the determined calibration value (a calibration value based on the automatic calibration job or a calibration value based on the manual calibration job).

Figure 9:
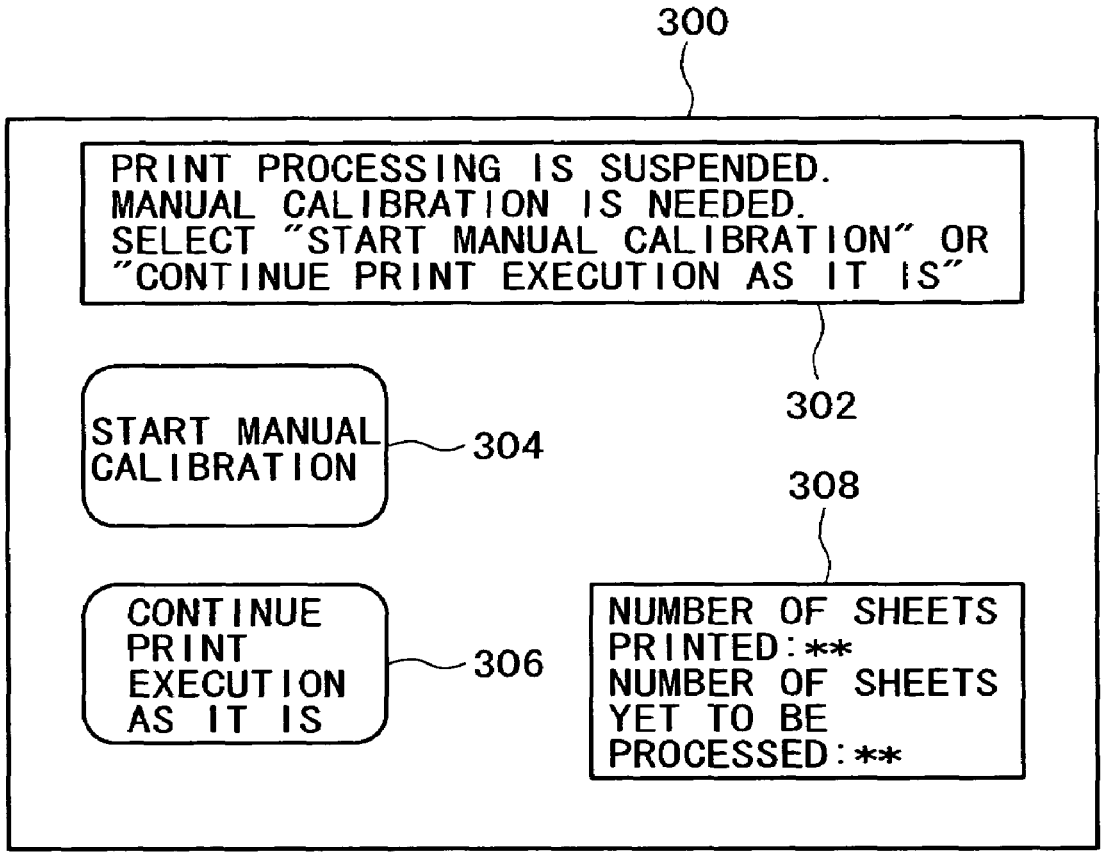
FIG. 9 shows an example of display screen displayed by an alarm issuing part 272 on a UI device 30.

FIG. 9 shows an example of display screen displayed by the alarm issuing part 272 on the UI device 30.

As illustrated in FIG. 9, the alarm issuing part 272 displays an alarm message 302, plural instruction areas 304 and 306, and a processing state message 308 on a touch panel 300 disposed on the UI device 30.

The available alternatives of the alarm message 302 to be shown in this example include a message to the effect that print processing is suspended, displayed when interrupted by a manual calibration job, a message that manual calibration is needed, displayed when the characteristic quantity of the test image is outside the target range of data, and a message to urge manual color calibration processing.

The first instruction area 304 is an area where the user's instruction to start manual color calibration processing is accepted, while the second instruction area 306 is an area where an instruction to continue print processing as it is without performing manual color calibration processing is accepted.

Also, the processing state message 308 includes information to notify the state of print processing requested by the user. The processing state message 308 in this example indicates the number of images which have been printed and that of images yet to be processed. This enables the user to determine, on the basis of the number of images yet to be printed and other factors, whether or not manual color calibration processing is needed.

In this way, the printer device 10 in this embodiment of the invention prints test images at a predetermined timing, and monitors the color development characteristics of the hardware on the basis of the printed test images. If any color development characteristic goes out of the target range, the printer device 10 displays the need for manual color calibration processing as warning information and thereby urges manual color calibration processing. This enables the printer device 10, if variations in color development characteristics are within a range permissible by the user, to apply automatic color calibration processing which takes less time and thereby reduce the impact on productivity or, if variations in color development characteristics go out of the permissible range, to apply manual color calibration processing to implement more accurate color calibration processing reflecting the user's preference.

Also, the printer device 10 monitors the result of automatically performed color calibration processing, and decides whether or not to cause the result of color calibration processing to be reflected in print processing. The printer device 10 thereby determines whether not the color development characteristics of the hardware have been corrected to the target state as a result of the automatic color calibration processing, and thereby prevents the result of color calibration processing of insufficient accuracy from being reflected in print processing.

Further, the printer device 10 monitors the color development characteristics of the hardware in accordance with the user's intention by displaying warning information according to a warning reference value entered by the user, and can thereby prevent execution of automatic color calibration processing at a level of calibration accuracy not conforming to the user's intention.

Next will be described an example of modification of the foregoing embodiment of the present invention.

The printer device 10, as described with reference to the foregoing embodiment, restricts the number of test images to be printed when color calibration processing is to be done automatically. However, in a state in which the number of test images is restricted, the printer device 10 may be sometimes unable to achieve the target state of correction irrespective of how many times it repeats automatic color calibration processing.

In view of this problem, the printer device 10 may be enabled to increase the number of test images to be printed or the number of recording paper sheets to be used for test image printing for the next round of color calibration processing if, on the basis of test images printed in a state in which the result of color calibration processing is reflected, the correction of color development characteristics by color calibration processing is found insufficient. Thus, according to the characteristic quantities of the test images extracted by the test image detecting part 248 (images reflecting the result of color calibration processing), the patch number setting part 212 alters the number and/or size of test images or the number of recording paper sheets on which the test images are to be printed.

Whereas the invention has been described with reference to the preferred embodiments thereof, the foregoing description is nothing to be construed in a limiting sense, but the following and other modifications and variations are also conceivable within the spirit and scope of the appended claims.

For instance, preferably, the image forming section executes consecutive formation processing to form images consecutively, the detecting section should detect the color development data during the execution of the consecutive formation processing, and the warning section should issue the warning information during the execution of the consecutive formation processing.

Preferably, the image forming section forms in a storage medium an image for color calibration during the consecutive formation processing in accordance with a request by a user, the detecting section should detect the color development data on the basis of the image for color calibration so formed in the storage medium, and the warning control section should compute a difference value between the color development data detected on the basis of the image for color calibration and the reference data and, if the computed difference value is greater than a predetermined value, decides that the warning information is issued.

Preferably, the image forming device further has a calibration section that performs first color calibration processing on the basis of the color development data detected by the detecting section, and the warning control section should decide whether or not to issue the warning information on the basis of color development data based on an image formed in a state reflecting a result of the first color calibration processing and the reference data.

Preferably, the image forming section forms at least the image for color calibration in the state reflecting the result of the first color calibration processing, the detecting section detects the color development data on the basis of the image formed in the state reflecting the result of the first color calibration processing, and the image forming device further has a calibration control section that decides on the basis of the color development data detected by the detecting section whether or not to have the result of color calibration processing reflected in the image formation processing requested by the user.

Preferably, the image forming section alters, according to the color development data detected by the detecting section, the number of images for color calibration to be formed in the storage medium or the number of storage media in which images for color calibration are to be formed.

Preferably, the warning section supplies information to urge the user to give an instruction to start second color calibration processing, which is higher in calibration accuracy than the first color calibration processing, as the warning information, and the calibration section, subject to inputting of the instruction, performs the second color calibration processing on the basis of the color development data detected by the detecting section.

Preferably, the image forming section forms an image for the first color calibration at a predetermined timing and form an image for the second color calibration at a timing according to the instruction, and the calibration section performs the first color calibration processing on the basis of the image for the first color calibration at the predetermined timing and performs the second color calibration processing on the basis of the image for the second color calibration at the timing according to the instruction.

Preferably, the image forming device further has a reference value setting section that sets a warning reference value for deciding whether or not to issue warning information according to an operation by the user, and the warning control section should compute the difference value between the color development data detected by the detecting section and the reference data and, if the computed difference value is greater than the warning reference value set by the reference value setting section, decides whether or not to issue the warning information.

Also, an image forming device according to the invention may have an image forming section that consecutively forms plural images on plural storage media, a detecting section that detects, on the basis of an image so formed in a storage medium, color development data indicating color development characteristics of the image, a calibration section that performs color calibration processing on the basis of the color development data detected by the detecting section, a warning control section that decides whether or not to issue warning information regarding the color development characteristics on the basis of the color development data detected by the detecting section from an image formed in a state in-which a result of the color calibration processing is reflected and reference data which the color development characteristics are to reference, and a warning section that issues the warning information regarding the color development characteristics in response to the decision by the warning control section.

A calibration method according to the invention is a calibration method for an image forming device to consecutively form plural images, whereby the image forming device consecutively forms plural images on plural storage media, detects, on the basis of one of plural images so formed, color development data indicating color development characteristics of the image, decides whether or not to issue warning information regarding color development characteristics on the basis of the detected the color development data and reference data which the color development characteristics are to reference and, if it is decided to issue the warning information, issues the warning information regarding the color development characteristics.

Also, a calibration method according to the invention may be a calibration method for an image forming device to consecutively form plural images, whereby the plural images are consecutively formed on plural storage media, color development data indicating color development characteristics of the image is detected on the basis of one of the plural images so formed on the storage media, color calibration processing is performed on the basis of the detected color development data, an image is formed in a state reflecting a result of the color calibration processing, the color development data is detected from the image formed in the state reflecting the result of the color calibration processing, and it is decided whether or not to have the result of the color calibration processing reflected in the image formation processing requested by a user on the basis of the color development data detected from the image formed in the state in which the result of the color calibration processing is reflected and reference data which the color development characteristics are to reference.

A storage medium storing a program according to the invention for use by an image forming device containing a computer causes the computer of the image forming device to execute a function for maintaining color development characteristics of consecutively formed images, the function including the steps of consecutively forming plural images on storage media; detecting, on the basis of one of the plural images so formed, color development data indicating color development characteristics of the image; deciding whether or not to issue warning information regarding the color development characteristics on the basis of the detected color development data and reference data which the color development characteristics are to reference; and issuing, if it is decided to issue the warning information, the warning information regarding the color development characteristics.

Also, a storage medium storing a program according to the invention for use by an image forming device containing a computer may cause the computer of the image forming device to implement functions of consecutively forming plural images on plural storage media; detecting, on the basis of one of the images so formed on the storage media, color development data indicating color development characteristics of the image; performing color calibration processing on the basis of the detected color development data; and deciding whether or not to issue warning information regarding the color development characteristics on the basis of the color development data detected from the image formed in a state in which a result of the color calibration processing is reflected and reference data which the color development characteristics are to reference.

An image forming device according to the invention can maintain color development characteristics of consecutively formed images.

The entire disclosure of Japanese Patent Application No. 2003-402638 filed on Dec. 2, 2003 including specification, claims, drawings and abstract is incorporated herein by reference in its entirety.

What is claimed is:

1. An image forming device comprising:

a image forming unit that consecutively forms a plurality of images on a plurality of recording media, a detector that detects, on the basis of an image formed in a storage medium, color development data indicating color development characteristics of the image, a warning controller that decides whether or not to issue warning information regarding the color development characteristics on the basis of the color development data detected by the detector and reference data which the color development characteristics are to reference, and a warning unit that issues warning information regarding the color development characteristics in response to the decision by the warning controller.

2. The image forming device according to claim 1, wherein:

the image forming unit executes image forming process to form images consecutively, the detector detects the color development data during the execution of the image forming process, and the warning unit issues the warning information during the execution of the image forming process.

3. The image forming device according to claim 2, wherein:

the image forming unit forms an image for color calibration on a recording medium during the image forming process in accordance with a request by a user, the detector detects the color development data on the basis of the image for color calibration formed on the recording medium, and the warning controller computes a difference value between the color development data detected on the basis of the image for color calibration and the reference data and, if the computed difference value is greater than a predetermined value, decides that the warning information should be issued.

4. The image forming device according to claim 3, wherein:

the image forming unit alters, according to the color development data detected by the detector, the number of images for color calibration to be formed in the storage medium or the number of recording media in which images for color calibration are to be formed.

5. The image forming device according to claim 1, further comprising:

a calibration unit that performs first color calibration processing on the basis of the color development data detected by the detector, wherein:

the warning controller decides whether or not to issue the warning information on the basis of color development data, which is formed in a state of reflecting a result of the first color calibration processing, and the reference data.

6. The image forming device according to claim 5, wherein:

the image forming unit forms at least the image for color calibration in the state of reflecting the result of the first color calibration processing, the detector detects the color development data on the basis of the image formed in the state of reflecting the result of the first color calibration processing, and there are further provided calibration controller that decides on the basis of the color development data detected by the detector whether or not to have the result of color calibration processing reflected in the image formation processing requested by the user.

7. The image forming device according to claim 5, wherein:

the warning unit supplies information to urge the user to give an instruction to start second color calibration processing, which is higher in calibration accuracy than the first color calibration processing, as the warning information, and the calibration unit, subject to inputting of the instruction, performs the second color calibration processing on the basis of the color development data detected by the detector.

8. The image forming device according to claim 7, wherein:

the image forming unit forms an image for the first color calibration at a predetermined timing and forms an image for the second color calibration at a timing according to the instruction, and the calibration unit performs the first color calibration processing on the basis of the image for the first color calibration at the predetermined timing and performs the second color calibration processing on the basis of the image for the second color calibration at the timing according to the instruction.

9. The image forming device according to claims 1, wherein:

there are further provided reference value setting unit that sets a warning reference value for deciding whether or not to issue warning information according to an operation by the user, and the warning controller computes the difference value between the color development data detected by the detector and the reference data and, if the computed difference value is greater than the warning reference value set by the reference value setting unit, decides whether or not to issue the warning information.

10. An image forming device comprising:

a image forming unit that consecutively forms a plurality of images on a plurality of recording media, a detector that detects, on the basis of an image formed on a recording medium, color development data indicating color development characteristics of the image, a calibration unit that performs color calibration processing on the basis of the color development data detected by the detector, a warning controller that decides whether or not to issue warning information regarding the color development characteristics on the basis of the color development data detected by the detecting means from an image formed in a state in which a result of the color calibration processing is reflected and reference data which the color development characteristics are to reference, and a warning unit that issues the warning information regarding the color development characteristics in response to the decision by the warning controller.

11. A calibration method for an image forming device to consecutively form a plurality of images, comprising:

consecutively forming a plurality of images on a plurality of recording media;

forming color development data indicating color development characteristics of the images detected on the basis of one of the plurality of images, deciding whether or not to issue warning information regarding the color development characteristics on the basis of the detected color development data and reference data which the color development characteristics are to reference and, issuing the warning information regarding the color development characteristics if it is decided to issue the warning information.

12. A calibration method for an image forming device to consecutively form a plurality of images, comprising:

consecutively forming the plurality of images on a plurality of recording media, detecting color development data indicating color development characteristics of the image on the basis of one of the plurality of images formed on the recording media, performing color calibration processing on the basis of the detected color development data, forming an image in a state of reflecting a result of the color calibration processing, detecting the color development data from the image formed in the state of reflecting the result of the color calibration processing, and deciding whether or not to have the result of the color calibration processing reflected in the image formation processing requested by a user on the basis of the color development data detected from the image formed in the state in which the result of the color calibration processing is reflected and reference data which the color development characteristics are to reference.

13. A storage medium readable by a computer, storing a program for use by an image forming device containing a computer causing the computer of the image forming device to execute a function for maintaining color development characteristics of consecutively formed images, the function comprising:

consecutively forming a plurality of images on recording media, detecting, on the basis of one of the plurality of images so formed, color development data indicating color development characteristics of the image, deciding whether or not to issue warning information regarding the color development characteristics on the basis of the detected color development data and reference data which the color development characteristics are to reference, and issuing, if it is decided to issue the warning information, the warning information regarding the color development characteristics.

14. A storage medium readable by a computer, storing a program for use by an image forming device containing a computer causing the computer of the image forming device to implement functions of:

consecutively forming a plurality of images on a plurality of recording media, detecting, on the basis of one of the images formed on the storage media, color development data indicating color development characteristics of the image, performing color calibration processing on the basis of the detected color development data, and deciding whether or not to issue warning information regarding the color development characteristics on the basis of the color development data detected from the image formed in a state in which a result of the color calibration processing is reflected and reference data which the color development characteristics are to reference.

* * * * *